US011385019B2

(12) United States Patent
Kincel et al.

(10) Patent No.: US 11,385,019 B2
(45) Date of Patent: Jul. 12, 2022

(54) DOUBLE WALLED HANDGUARD FOR FIREARM

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 55 days.

(21) Appl. No.: 16/359,865

(22) Filed: Mar. 20, 2019

(65) Prior Publication Data

US 2020/0300577 A1 Sep. 24, 2020

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 4,663,875 A * 5/1987 Tatro ..... F41C 23/16 165/134.1
5,010,676 A * 4/1991 Kennedy ..... F41C 23/16 42/71.01
6,490,822 B1 * 12/2002 Swan ..... F41C 23/00 42/124
6,945,154 B1 * 9/2005 Luth ..... F41A 13/12 89/14.1
RE39,465 E * 1/2007 Swan ..... 42/124
7,640,689 B2 * 1/2010 Fluhr ..... F41C 23/16 42/72
8,336,243 B2 * 12/2012 Langevin ..... F41C 23/16 42/71.01
8,453,364 B2 * 6/2013 Kucynko ..... F41C 23/16 42/71.01
8,522,467 B1 * 9/2013 Christensen ..... F41C 23/16 42/71.01

(Continued)

OTHER PUBLICATIONS

BCM, "Combat Rail Systems", https://www.magpul.com/ip, website available prior to Mar. 20, 2019.

(Continued)

*Primary Examiner* — Michelle Clement
(74) *Attorney, Agent, or Firm* — Michael Best & Friedrich LLP

(57) ABSTRACT

A double-walled handguard for a firearm includes an inner tube and an outer tube connected by longitudinally-extending struts. A circumferential gap is formed between the inner and outer tubes. The handguard can be extruded as a blank and feature such as accessory rails and accessory mounting apertures can be machined into the blank to arrive at the desired configuration. Vent holes may be machined into the outer tube to provide a venting path for hot air in the circumferential gap. The double-walled handguard is expected to have increased strength compared to a single-walled handguard and better shield the user's hands from heat generated by the barrel of the firearm.

22 Claims, 6 Drawing Sheets

(56) References Cited

U.S. PATENT DOCUMENTS 8,640,372 B2 * 2/2014 Hochstrate ..... F41A 5/18 42/111
8,904,691 B1 12/2014 Kincel
9,658,010 B1 * 5/2017 Oglesby ..... F41A 13/12
10,066,897 B2 9/2018 Hwang et al.
10,274,283 B1 * 4/2019 Oglesby ..... F41C 23/16
10,295,304 B1 * 5/2019 Kincel ..... F41C 23/16
10,480,896 B2 * 11/2019 Jen ..... F41C 23/16
2006/0236582 A1 * 10/2006 Lewis ..... F41A 3/36 42/73
2007/0033851 A1 * 2/2007 Hochstrate ..... F41A 5/18 42/75.01
2010/0269392 A1 * 10/2010 Swan ..... F41C 23/16 42/71.01
2010/0319231 A1 * 12/2010 Stone ..... F41C 23/00 42/71.01
2011/0214328 A1 * 9/2011 Williams ..... F41G 11/003 42/90
2012/0017482 A1 * 1/2012 Chvala ..... F41C 23/16 42/71.01
2012/0167434 A1 * 7/2012 Masters ..... F41C 23/16 42/90
2014/0000142 A1 * 1/2014 Patel ..... F41C 23/16 42/14
2014/0076146 A1 * 3/2014 Gomez ..... F41A 21/00 89/191.01
2014/0082990 A1 * 3/2014 Lee ..... F41A 21/24 42/96
2014/0157640 A1 * 6/2014 Whelan ..... F41C 23/16 42/75.02
2014/0224114 A1 * 8/2014 Faxon ..... F41A 3/66 89/193
2014/0305019 A1 * 10/2014 King, Jr. ..... F41C 23/18 42/71.01
2014/0325889 A1 * 11/2014 Michal ..... F41G 11/003 42/75.01
2015/0345896 A1 * 12/2015 Michal ..... F41C 23/16 42/75.01
2016/0054096 A1 * 2/2016 Dzwill ..... F41A 21/48 42/75.02
2016/0298925 A1 * 10/2016 Gottzmann ..... F41G 11/003
2017/0205183 A1 * 7/2017 Ding ..... F41A 35/02
2017/0234646 A1 * 8/2017 Flagler ..... F41G 11/003 42/71.01
2017/0299291 A1 * 10/2017 Spector ..... F41A 13/12
2018/0010881 A1 * 1/2018 Garst ..... F41C 23/16
2018/0202757 A1 * 7/2018 Samson ..... F41A 3/66
2018/0202758 A1 * 7/2018 Samson ..... F41A 3/66
2018/0202759 A1 * 7/2018 Samson ..... F41A 21/48
2019/0101355 A1 * 4/2019 Hubbell ..... F41C 23/16
2019/0113306 A1 * 4/2019 Kincel ..... F41C 23/16
2019/0162503 A1 * 5/2019 Keeney ..... F41C 23/16
2019/0162504 A1 * 5/2019 Keeney ..... F41C 23/16
2019/0162505 A1 * 5/2019 Mezynski ..... F41C 27/00
2020/0173755 A1 * 6/2020 Gonzales ..... F41G 11/003
2020/0232734 A1 * 7/2020 Herring ..... F41A 17/40
2020/0284535 A1 * 9/2020 Drake ..... F41C 23/16

OTHER PUBLICATIONS

BCM, https://www.primaryarms.com/SSP%20Applications/NetSuite%20Inc.%20-%20SCA%20Mont%20Blanc/Development/img/BCM-QRF-10-556-BLK_00.jpg, webpage available prior to Mar. 20, 2019.

BCM, https://www.primaryarms.com/SSP Applications/NetSuite Inc. - SCA Mont Blanc/Development/img/BCM-QRF-12-556-BLK_00.jpg, webpage available prior to Mar. 20, 2019.

BCM, https://cdn3.volusion.com/j4enh.r2en5/v/vspfiles/photos/BCM-QRF-8-556-BLK-3.jpg?1506345137, webpage available prior to Mar. 20, 2019.

* cited by examiner

DOUBLE WALLED HANDGUARD FOR FIREARM

BACKGROUND

The present invention relates to a double-walled handguard for a firearm.

SUMMARY

In one embodiment, the invention provides a handguard for mounting around a barrel of a firearm, the handguard comprising: an inner tube surrounding a portion of the barrel; an outer tube surrounding the inner tube; a plurality of radial struts interconnecting the inner tube and the outer tube to create a circumferential gap between the inner tube and outer tube; and a plurality of accessory mounting apertures in the outer tube for mounting a plurality accessories to the handguard.

In one aspect of the invention, the inner tube includes a plurality of clearance apertures aligned with the accessory mounting apertures, such that ends of fasteners used to secure an accessory to the handguard extend into the clearance apertures. In one aspect of the invention, the outer tube includes a plurality of flat surfaces and the accessory mounting aperture is formed in one of the flat surfaces. In one aspect of the invention, the outer tube includes more than three flat surfaces in which accessory apertures are formed. In one aspect of the invention, the outer tube includes at least five flat surfaces in which accessory apertures are formed. In one aspect of the invention, the outer tube has an octagonal cross-section eight vertices; the radial struts intersect at a plurality of the vertices; and the plurality of accessory mounting apertures are formed in at least two surfaces of the octagonal outer tube. In one aspect of the invention, the outer tube includes vent holes for venting air from the circumferential gap. In one aspect of the invention, the circumferential gap is sized to accommodate mounting nuts for the plurality of accessories. In one aspect of the invention, the radial struts extend lengthwise along the inner and outer tubes to divide the circumferential gap into lengthwise segments. In one aspect of the invention, the inner tube and outer tube are concentric about a longitudinal axis of the handguard.

The invention also provides a method of manufacturing a handguard for a firearm, the method comprising the steps of: (a) forming a blank comprising an inner tube, and outer tube surrounding the inner tube, and a plurality of radial struts interconnecting the inner tube and the outer tube to create a circumferential gap between the inner tube and outer tube; and (b) forming into the outer tube a plurality of accessory mounting apertures to facilitate mounting accessories to the handguard.

In one aspect, the invention further comprises the step of forming into the inner tube a plurality of clearance apertures aligned with the accessory mounting apertures, such that ends of fasteners used to secure an accessory to the handguard extend into the clearance apertures. In one aspect of the invention, step (a) includes providing a plurality of flat surfaces on the outer tube and step (b) includes forming the accessory mounting apertures into the flat regions. In one aspect of the invention, step (a) includes providing more than three flat surfaces on the outer tube and step (b) includes forming the accessory apertures into the flat regions. In one aspect of the invention, step (a) includes forming the outer tube with an octagonal cross-section eight vertices; step (a) further includes forming the radial struts at a plurality of the vertices; and step (b) includes forming the accessory mounting apertures into at least two sides of the octagonal outer tube. In one aspect, the invention further comprises forming a plurality of vent holes in the outer tube for venting air from the circumferential gap through the vent holes. In one aspect of the invention, step (a) includes sizing the circumferential gap to accommodate mounting nuts for the plurality of accessories. In one aspect of the invention, step (a) includes dividing with the struts the circumferential gap into peripheral segments. In one aspect, the invention further comprises forming communicating holes through the struts to place the peripheral segments in communication with each other. In one aspect of the invention, step (a) includes forming the outer tube and inner tube concentrically about a longitudinal axis. In one aspect of the invention, step (a) includes extruding the blank and step (b) includes machining the accessory mounting apertures into the outer tube. In one aspect of the invention, step (a) includes extruding the blank with at least five bores.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
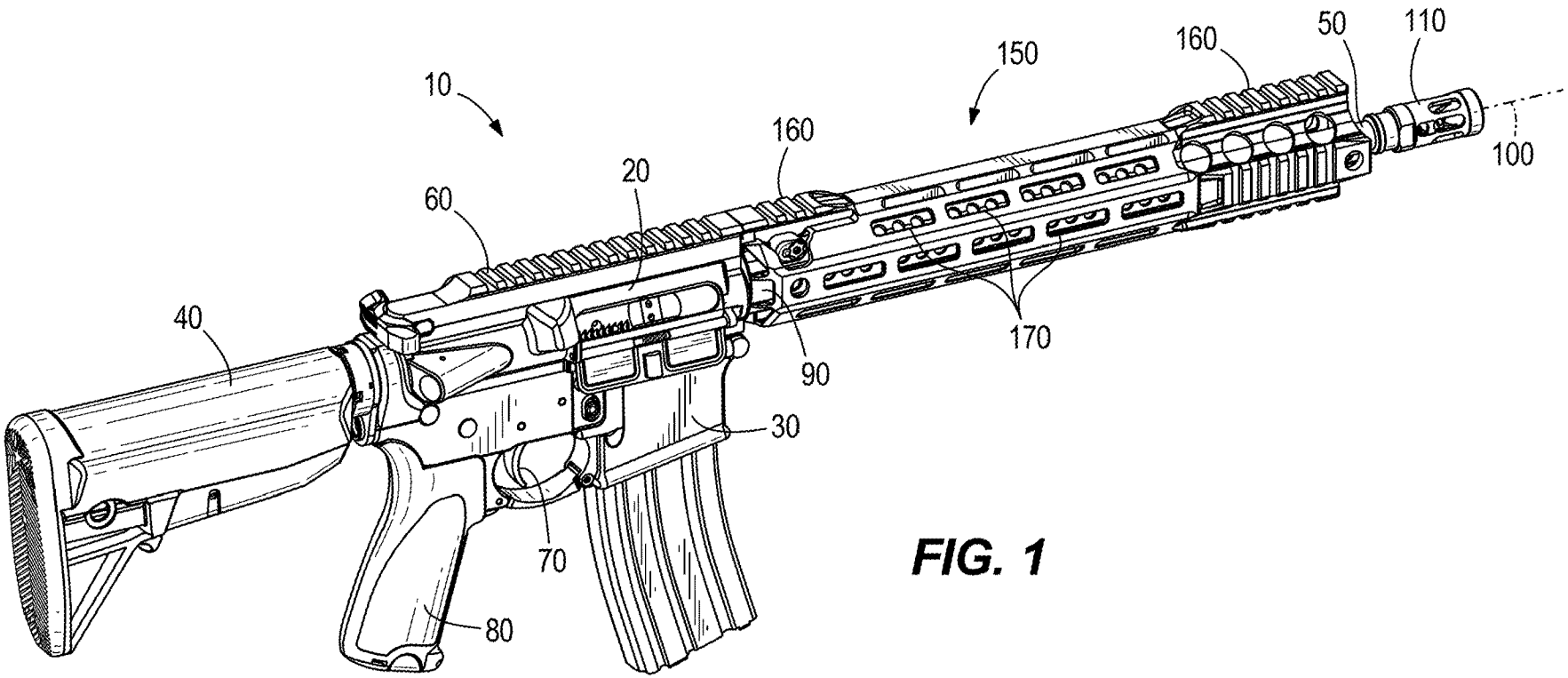
FIG. 1 is a perspective view of a firearm having a double-walled handguard according to the present invention.

FIG. 1 illustrates a firearm 10 in the form of an AR-15 carbine or rifle. The firearm 10 has well-known components, such as an upper receiver 20, a lower receiver 30, a buttstock 40, and a barrel 50. A handguard 150 according to the present invention surrounds the barrel 50 and will be discussed below. The upper receiver 20 includes the firing and reloading action of the firearm 10. The upper receiver 20 includes an upper receiver accessory rail 60 (in the form of a Picatinny rail in the illustrated embodiment) running along the top of the upper receiver 20. The lower receiver 30 is below the upper receiver 20 and includes a trigger assembly 70 for actuating the firing action in the upper receiver 20 and also includes a pistol grip 80 for the user to grasp during operation. The buttstock 40 extends rearwardly of the upper receiver 20 and is held against a user's shoulder during firing. The barrel 50 is mounted to the upper receiver 20 with a barrel nut 90. The barrel 50 extends forward from the upper receiver 20 and defines a longitudinal axis 100. A flash suppressor 110 may be mounted to the end of the barrel 50 to reduce the visibility of burning gases exiting the barrel 50 while firing the weapon.

Figure 2:
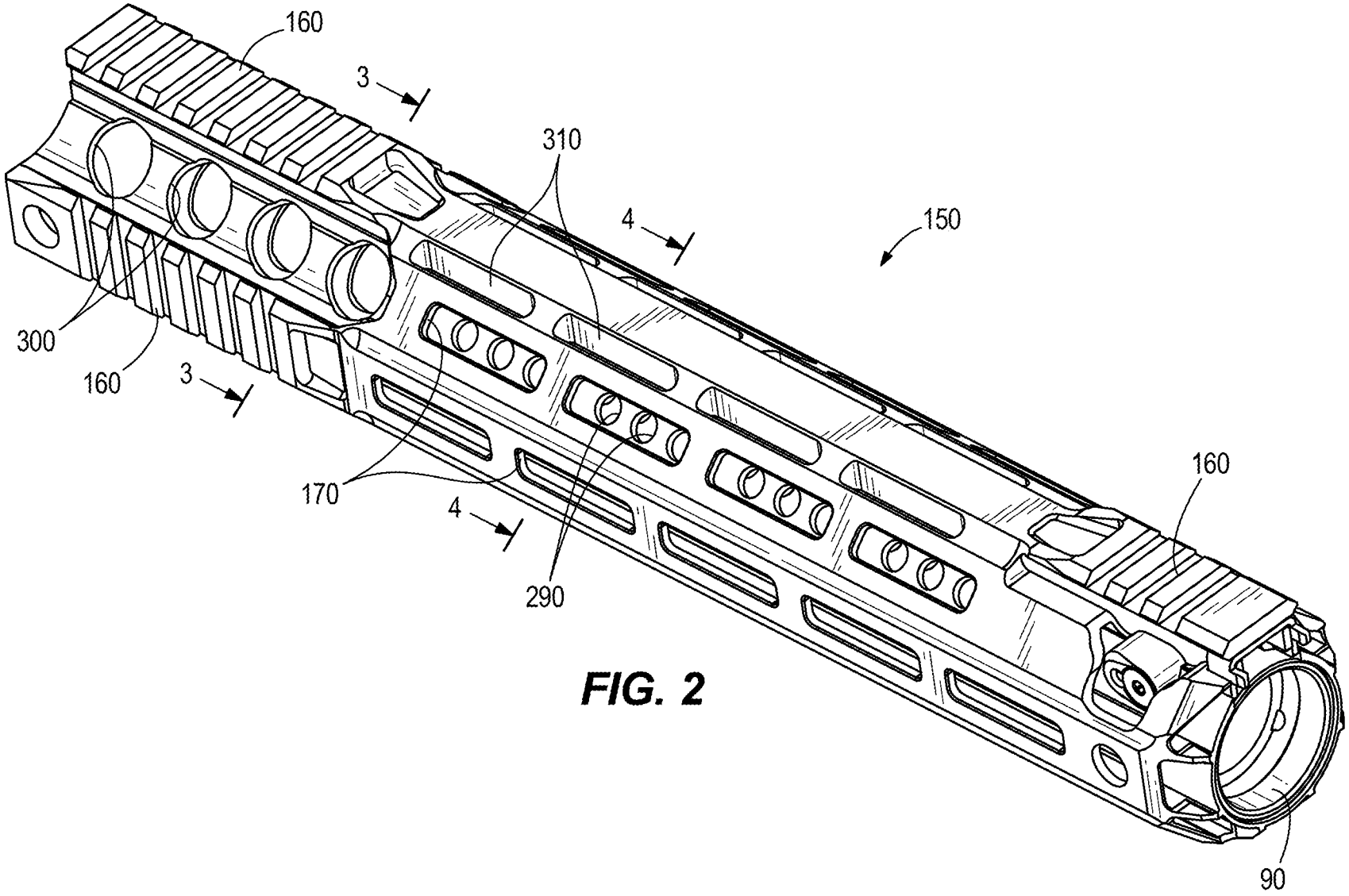
FIG. 2 is a perspective view of the handguard.

With reference to FIGS. 1 and 2, the handguard 150 is mounted at one end to the outer surface of the barrel nut 90 which interconnects the barrel 50 to the upper receiver 20. The handguard 150 surrounds the barrel 50 and provides a convenient place for the user to grasp while firing the firearm 10. The handguard 150 extends in cantilever fashion forward along the longitudinal axis 100 from the upper receiver 20 to a distal end. As illustrated, the handguard 150 is concentric with the barrel longitudinal axis 100.

The illustrated handguard 150 includes accessory mounts in the form of handguard accessory rails 160, a plurality of accessory mounting apertures 170, or any other form of an accessory mount. The illustrated handguard accessory rails 160 are forward and rear Picatinny rails running along the top of the handguard 150 (i.e., at the twelve o'clock position of a clock face superimposed on the cross-section) and also Picatinny rails in the rear portion of the handguard 150 at the three o'clock, six o'clock, and nine o'clock positions. The top handguard accessory rails 160 align with the upper receiver accessory rail 60 in the illustrated configuration. The accessory mounting apertures 170 may take the form of M-Lok slots, KeyMod slots, or H Key slots. Accessories (e.g., flashlight, laser sight, scope, hand grip) can be attached to the handguard 150 by way of the accessory mounting apertures 170 to enhance efficacy of the firearm 10 in the hands of its user.

Figure 3:
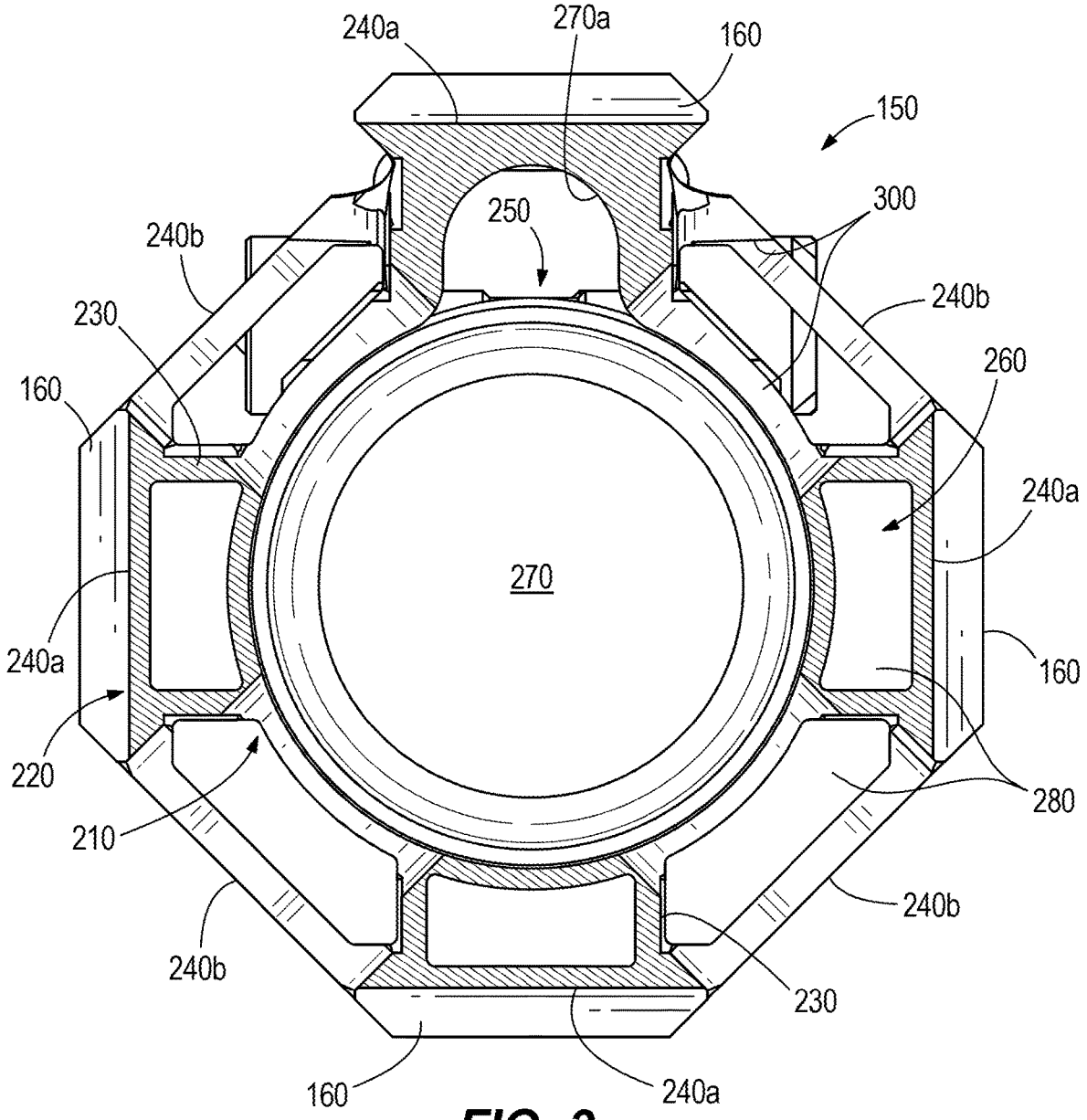
FIG. 3 is a cross-section view of the handguard taken along line 3-3 in FIG. 2.
Figure 4:
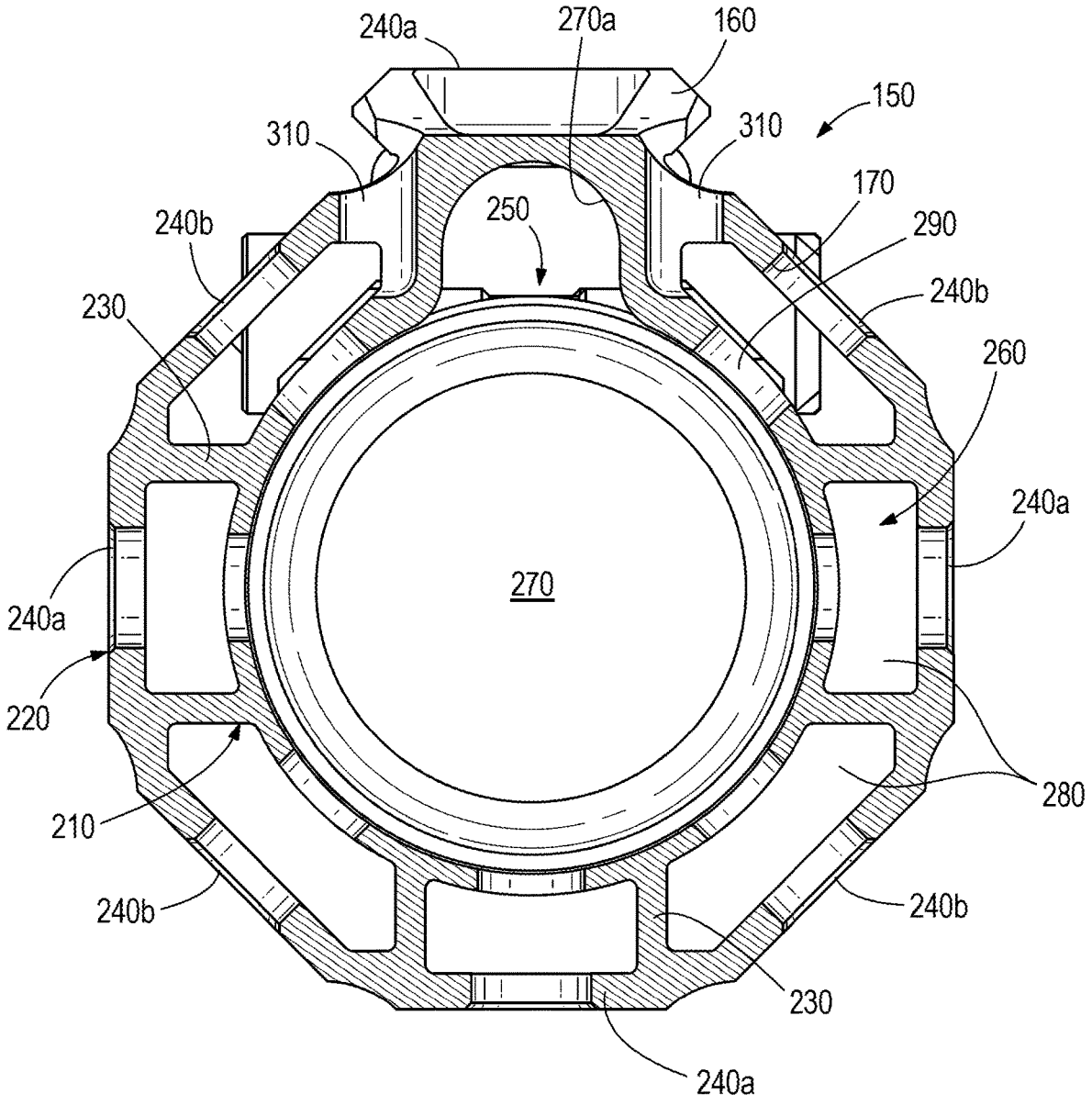
FIG. 4 is a cross-section view of the handguard taken along line 4-4 in FIG. 2.

Referring to FIGS. 3 and 4, the handguard 150 includes an inner tube 210, an outer tube 220, and a plurality of radial struts 230 interconnecting the inner tube 210 and outer tube 220. As illustrated, the inner tube 210 and outer tube 220 are concentric with each other. The inner tube 210 may be cylindrical with a circular cross-section and the outer tube 220 may be include a plurality of flat surfaces or regions 240*a*, 240*b*. The inner tube 210 surrounds a portion of the barrel 50 and the outer tube 220 surrounds the inner tube 210. The inner tube 210 includes a gap 250 at the top as will be explained further below.

In the illustrated embodiment, the outer tube 220 has an octagonal cross-section with four primary flat regions 240*a* and four secondary flat regions 240*b*. When properly installed, the four primary flat regions 240*a* are at the twelve o'clock, three o'clock, six o'clock, and nine o'clock positions of a clock face superimposed on the cross-section. The four secondary flat regions 240*b* are nominally at the one-thirty, four-thirty, seven-thirty, and ten-thirty clock positions, connecting or bridging between the primary flat regions 240*a*. Other outer tube 220 shapes are contemplated by the present invention. For example, the outer tube 220 may include four or more flat regions around its outer surface and the flat regions can be non-symmetrical and of not the same width depending on the application. The accessory mounts 160, 170 can be positioned on or in any of the flat regions of the outer tube 220.

The illustrated embodiment includes eight radial struts 230 which connect at the eight vertices of the octagonal cross-section outer tube 220 (i.e., the eight intersections of the primary and secondary flat regions 240*a*, 240*b*). The radial struts 230 extend in the longitudinal direction along the entire lengths of the inner and outer tubes 210, 220. The struts 230 also extend radially from the inner tube 210 to the outer tube 220 to create and maintain a circumferential gap 260 between the inner tube 210 and outer tube 220. The circumferential gap 260, which can be referred to as an annular spacing or gap or an annulus, is bounded by the inner tube 210 and outer tube 220. The circumferential gap 260 may be of constant radial thickness or width around the circumference of the inner tube 210 or may vary depending on the shapes of the tubes 210, 220 and the desired result. The radial thickness or width of the circumferential gap 260 can be set to accommodate known fasteners (e.g., T-nuts and the like) of known accessory mounting systems. The circumferential gap 260 can provide an additional benefit of capturing the fasteners if they become detached from the accessory or accessory mounting system.

The double-wall (tube-within-a-tube) configuration with struts is structurally similar to an I-beam. Spacing the tube walls 210, 220 from each other with the struts 230 provides a relatively high mass moment of inertia (and therefore stiffness) compared to a single-tube handguard, much like an I-beam provides a higher mass moment of inertia compared to a standard beam.

The handguard 150 is preferably manufactured by extruding a concentric tube blank from any extrudable material ideal for firearm use. For example, the material might be one of many available temperature resistant, high strength polymers, resins, composites, or carbon fiber materials or an alloy of magnesium, aluminum, and titanium or a suitable carbon or stainless steel. The tube blank includes the inner tube 210, outer tube 220, and struts 230. The tube blank includes eight bores comprising a central bore 270 and seven peripheral bores or segments 280. The central bore 270 is inside the inner tube 210 and also includes a top lobe 270*a* at the twelve o'clock position which defines the gap 250 in the inner tube 210. The top lobe 270*a* accommodates the gas tube of the firearm 10, which runs along the top of the barrel 50. Each of the seven peripheral bores 280 is bounded by the outer surface of the inner tube 210, the inner surface of the outer tube 220, and two of the struts 230.

It should be noted that the present invention can be extruded with the central bore 270 and four or more peripheral bores 280 (i.e., at least five bores), resulting potentially in a double-walled handguard having four or more flat portions 240 on the outer tube 220 for accessory mounts 160, 170. The handguard 10 can be extruded with five, six, seven, eight (as illustrated) or more bores and flat portions depending on the application.

The tube blank is machined to form the accessory mounts 160, 170 in the flat portions 240*a*, 240*b* of the outer tube 220. The term "machine" and its derivatives (e.g., "machined") includes any process of forming by elimination, for example grinding, drilling, and cutting. The tube blank can be machined to form any conceivable combination of accessory rails and accessory mounting apertures, including but not limited to Picatinny rails, KeyMod slots, M-Lok slots, or HKey slots. The illustrated configuration is not intended to be limiting. For example, accessory rails 160 could be machined into any of the flat portions 240*a*, 240*b*. Indeed, in the illustrated embodiment accessory rails 160 are machined into the four primary flat portions 240*a* in the rear portion of the handguard 10 as seen in FIGS. 1, 2 and 3. As illustrated in FIGS. 1 and 2, the accessory rails 160 do not have to extend the entire length of the handguard 150. A flat section can be machined into the blank between the two accessory rails 160 as illustrated.

Likewise, any kind of accessory mounting aperture 170 or combination of aperture types could be machined into any of the flat portions 240*a*, 240*b*. With reference to FIG. 4, clearance apertures or holes 290 may be machined into the inner tube 210 to accommodate the end of a fastener that is used to secure an accessory in a corresponding accessory mounting aperture 170 in the outer tube 220. The clearance holes 290 are positioned opposite the accessory mounting apertures 170 where such fasteners are expected to extend.

Referring to FIGS. 2 and 3, weight-saving features such as weight-saving or lightening apertures 300 can be machined into the inner and outer tube 210, 220 walls to remove material and thereby reduce the overall weight of the handguard 150. Additionally, portions of the outer tube 220 could be completely machined away in some embodiments to reduce weight and expose the inner tube 210 in that portion of the handguard 150. In such case, an accessory mount 160, 170 or lightening apertures 300 could be machined into the exposed portion of the inner tube 210 for a desired attachment system or weight reduction.

Referring to FIGS. 2 and 4, another feature that can be machined into the tube blank when forming the handguard 150 is venting holes 310 in the top of the outer tube 220 and communication holes through the struts 230 to place the peripheral bores 280 in communication with each other. As the firearm 10 is fired, the barrel 50 can become hot. Heat from the barrel 50 is transferred to the air around the barrel 50 inside the handguard 150. The hot air migrates between the peripheral bores 280, naturally rising to the top of the circumferential gap 260 (which comprises the peripheral bores 280 in communication with each other). The venting holes 310 permit hot air to escape the circumferential gap 260 in an efficient manner to the sides of any site on top of the upper receiver 20 and handguard 150 such reduce distraction due to the mirage effect of such rising hot air.

The relatively large mass or surface area of the double-walled handguard 150 and the insulating layer of air in the circumferential gap 260 are expected to reduce the temperature of the outer tube 220 compared to the temperature of a similarly sized single-wall handguard. This should result in more comfort for the firearm user.

Figure 5:
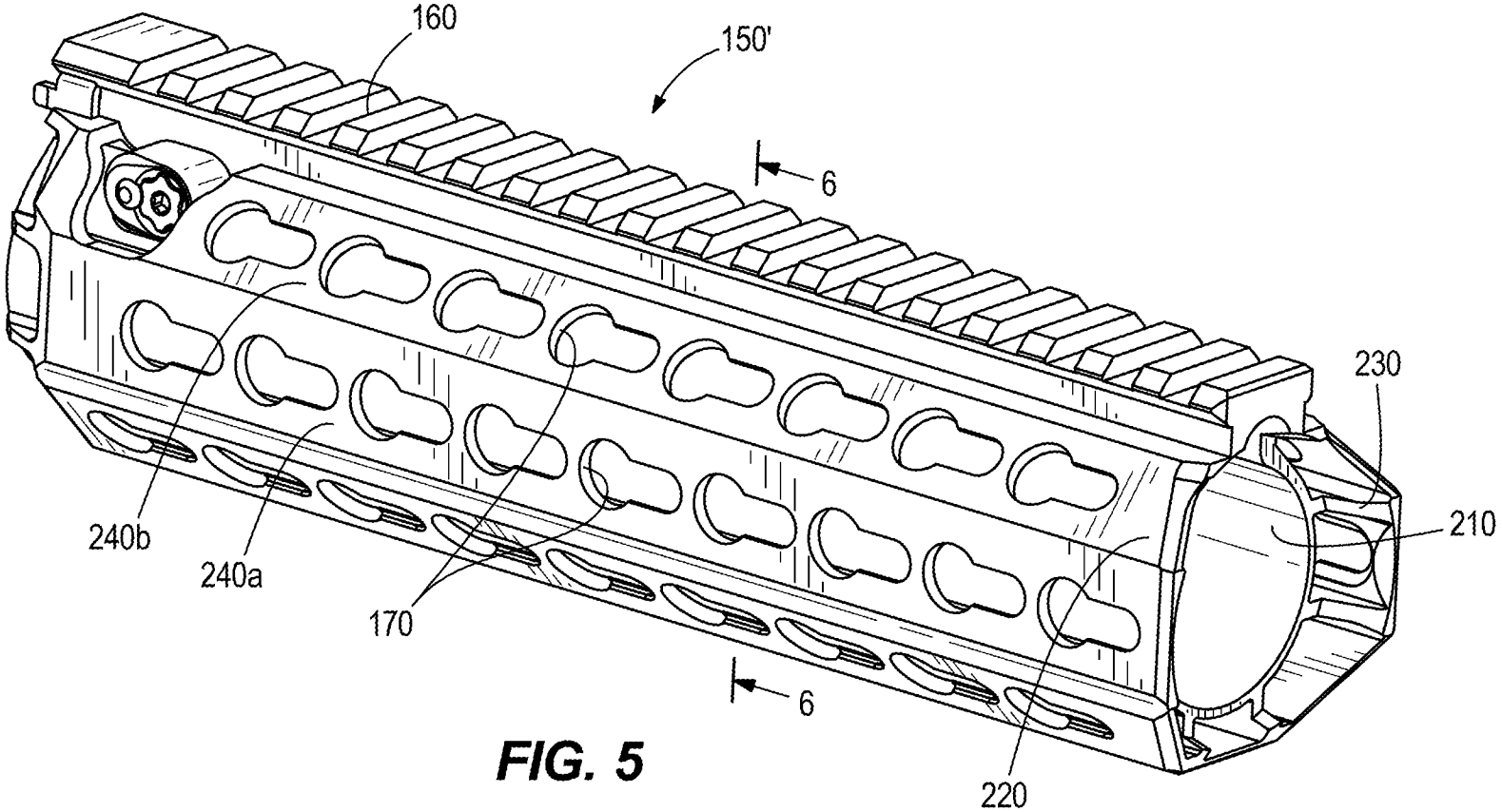
FIG. 5 is a perspective view of an alternative configuration of the handguard.
Figure 6:
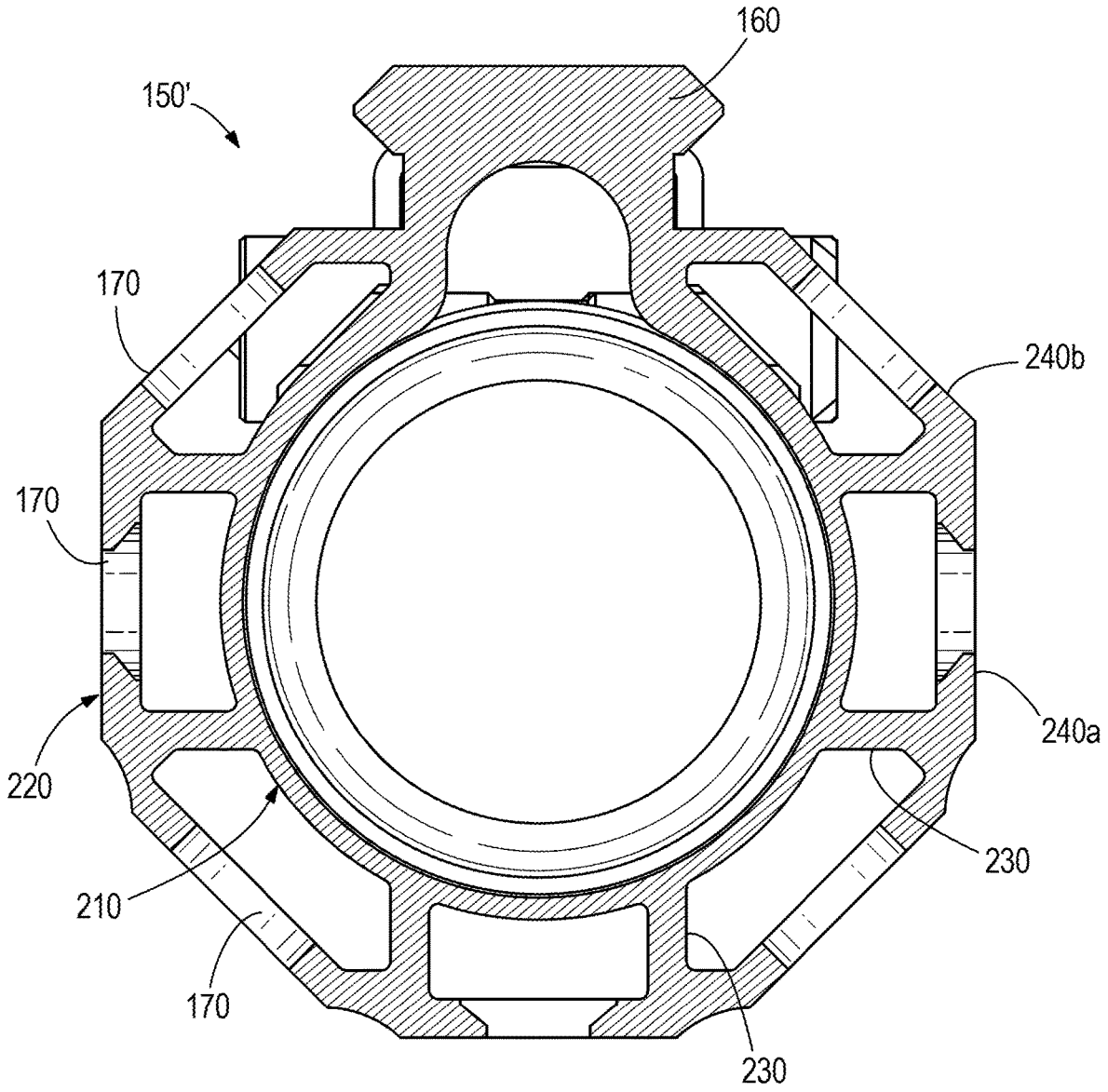
FIG. 6 is a cross-section view of the handguard taken along line 6-6 in FIG. 5.

FIGS. 5 and 6 illustrate another configuration of the handguard 150'. The handguard 150' is made the same way as described above, namely with an extruded double-wall blank into which features are machined. The features of the handguard 150' are accessory mounts 160, 170 in the form of Keymod slots formed in the flat regions 240*a*, 240*b* and a Picatinny rail on top. Because the Keymod system does not use T-nuts and relatively long fasteners, there is no need for the clearance holes in the inner tube 210. When desirable, weight lightening apertures may be machined into the inner tube 210 or outer tube 220 or both as discussed above.

Thus, the present invention provides a handguard and a method of manufacturing a handguard. The handguard includes inner and outer tubes spaced apart from each other via a plurality of struts to define a circumferential gap between the tubes. The handguard includes a plurality of accessory mounts, which can include accessory rails and accessory mounting apertures. These and other aspects of the invention are recited in the following claims.

What is claimed is:

1. A handguard for mounting around a barrel of a firearm, the handguard comprising:

an inner tube surrounding a portion of the barrel;

an outer tube surrounding the inner tube;

a plurality of radial struts interconnecting the inner tube and the outer tube to create a circumferential gap between the inner tube and outer tube; and a plurality of accessory mounting apertures in the outer tube for mounting a plurality of accessories to the handguard, wherein the inner tube, the outer tube, and the plurality of radial struts are integrally formed together from a single piece of material.

2. The handguard of claim 1, wherein the inner tube includes a plurality of clearance apertures aligned with the accessory mounting apertures, such that ends of fasteners used to secure an accessory to the handguard extend into the clearance apertures.

3. The handguard of claim 1, wherein the outer tube includes a plurality of flat surfaces and the accessory mounting aperture is formed in one of the flat surfaces.

4. The handguard of claim 1, wherein the outer tube includes more than three flat surfaces in which accessory apertures are formed.

5. The handguard of claim 1, wherein the outer tube includes at least five flat surfaces in which accessory apertures are formed.

6. The handguard of claim 1, wherein the outer tube has an octagonal cross-section eight vertices; the radial struts intersect at a plurality of the vertices; and the plurality of accessory mounting apertures are formed in at least two surfaces of the octagonal outer tube.

7. The handguard of claim 1, wherein the outer tube includes vent holes for venting air from the circumferential gap.

8. The handguard of claim 1, wherein the circumferential gap is configured to accommodate mounting nuts for the plurality of accessories.

9. The handguard of claim 1, wherein the inner tube and outer tube are concentric about a longitudinal axis of the handguard.

10. A method of manufacturing a handguard for a firearm, the method comprising the steps of:

(a) forming a blank comprising an inner tube, an outer tube surrounding the inner tube, and a plurality of radial struts interconnecting the inner tube and the outer tube to create a circumferential gap between the inner tube and outer tube; and (b) forming into the outer tube a plurality of accessory mounting apertures to facilitate mounting accessories to the handguard.

11. The method of claim 10, further comprising the step of forming into the inner tube a plurality of clearance apertures aligned with the accessory mounting apertures, such that ends of fasteners used to secure an accessory to the handguard extend into the clearance apertures.

12. The method of claim 10, wherein step (a) includes providing a plurality of flat surfaces on the outer tube and step (b) includes forming the accessory mounting apertures into the flat regions.

13. The handguard of claim 10, wherein step (a) includes providing more than three flat surfaces on the outer tube and step (b) includes forming the accessory apertures into the flat regions.

14. The method of claim 10, wherein step (a) includes forming the outer tube with an octagonal cross-section eight vertices; step (a) further includes forming the radial struts at a plurality of the vertices; and step (b) includes forming the accessory mounting apertures into at least two sides of the octagonal outer tube.

15. The method of claim 10, further comprising forming a plurality of vent holes in the outer tube for venting air from the circumferential gap through the vent holes.

16. The method of claim 10, wherein step (a) includes sizing the circumferential gap to accommodate mounting nuts for the plurality of accessories.

17. The method of claim 10, wherein step (a) includes dividing with the struts the circumferential gap into peripheral segments.

18. The method of claim 17, further comprising forming communicating holes through the struts to place the peripheral segments in communication with each other.

19. The method of claim 10, wherein step (a) includes forming the outer tube and inner tube concentrically about a longitudinal axis.

20. The method of claim 19, wherein step (a) includes extruding the blank and step (b) includes machining the accessory mounting apertures into the outer tube.

21. The method of claim 20, wherein step (a) includes extruding the blank with at least five bores.

22. A handguard for mounting around a barrel of a firearm, the handguard comprising:

an inner tube surrounding a portion of the barrel;

an outer tube surrounding the inner tube and spaced radially from the inner tube to define a circumferential gap between the inner tube and the outer tube;

a plurality of radial struts interconnecting the inner tube and the outer tube, wherein the radial struts extend lengthwise along the inner and outer tubes to divide the circumferential gap into at least four peripheral cavities; and a plurality of accessory mounting apertures in the outer tube for mounting a plurality accessories to the handguard, wherein the outer tube includes more than three flat surfaces in which the accessory mounting apertures are formed, wherein the inner tube includes a plurality of clearance apertures aligned with the accessory mounting apertures and configured such that at least one clearance aperture is aligned with each of the accessory mounting apertures and such that ends of fasteners used to secure an accessory to the handguard extend into the clearance apertures.

* * * * *